US006357968B1

(12) United States Patent
Dwyer et al.

(10) Patent No.: US 6,357,968 B1
(45) Date of Patent: Mar. 19, 2002

(54) METHOD AND APPARATUS FOR CONSTRUCTING AN UNDERGROUND BARRIER WALL STRUCTURE

(75) Inventors: Brian P. Dwyer, Albuquerque, NM (US); Willis E. Stewart, W. Richland, WA (US); Stephen F. Dwyer, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/482,303

(22) Filed: Jan. 12, 2000

(51) Int. Cl.[7] ..... E02D 5/18

(52) U.S. Cl. ..... 405/269; 405/128.1; 405/129.45

(58) Field of Search ..... 405/128.15, 128.3, 405/125.45, 128.7, 128.5, 128.75, 129.1, 129.25, 129.3, 129.4, 129.45, 129.6, 129.65, 129.8; 12/269, 267, 266, 263, 264

(56) References Cited

U.S. PATENT DOCUMENTS

| | | | | |
|---|---|---|---|---|
| 3,802,203 A | | 4/1974 | Ichise et al. | 61/36 R |
| 4,047,580 A | | 9/1977 | Yahiro et al. | 175/67 |
| 4,057,969 A | | 11/1977 | Rochmann | 61/35 |
| 4,212,565 A | | 7/1980 | Watabe | 405/269 |
| 4,249,836 A | | 2/1981 | Schmednecht | 405/267 |
| 4,304,507 A | | 12/1981 | Sato | 405/267 |
| 4,552,486 A | * | 11/1985 | Knox et al. | 405/227 |
| 4,697,953 A | | 10/1987 | Nussbaumer et al. | 405/128 |
| 4,909,675 A | | 3/1990 | Taki | 405/267 |
| 4,971,480 A | | 11/1990 | Nakanishi | 405/269 |
| 5,118,223 A | | 6/1992 | Taki | 405/267 |
| 5,158,613 A | * | 10/1992 | Sargeant et al. | 106/737 |

(List continued on next page.)

OTHER PUBLICATIONS

"Assessment of Barrier Containment Technologies: A Comprehensive Treatment for Enviornmental Remediation Applications", edited by Ralph R. Rumer and James K. Mitchell, Proceedings of the International Containment Technology Workshop, Baltimore, Maryland, Aug. 29–31, 1995, NTIS Publication #PB96–180583, pp. 45–55, 70–75, 185–209.

"Subsurface Barrier Technologies: Engineering Advancements and Application Considerations for Innovative Barrier Technologies", Conference Proceedings, Jan. 26–27, 1998, The Westin La Paloma, Tucson, AZ, Published by International Business Communications, 225 Turnpike Road, Southborough, MA 01772–1749, USA (508) 481–6400, "Remediation of Deep Soil and Groundwater Contamination using Jet Grouting and Innovative Materials", by Brian Dwyer, Sandia National Laboratories.

*Primary Examiner*—Robert E. Pezzuto
*Assistant Examiner*—Raymond W Addie
(74) *Attorney, Agent, or Firm*—Robert D. Watson

(57) ABSTRACT

A method and apparatus for constructing a underground barrier wall structure using a jet grout injector subassembly comprising a pair of primary nozzles and a plurality of secondary nozzles, the secondary nozzles having a smaller diameter than the primary nozzles, for injecting grout in directions other than the primary direction, which creates a barrier wall panel having a substantially uniform wall thickess. This invention addresses the problem of the weak "bow-tie" shape that is formed during conventional jet injection when using only a pair of primary nozzles. The improvement is accomplished by using at least four secondary nozzles, of smaller diameter, located on both sides of the primary nozzles. These additional secondary nozzles spray grout or permeable reactive materials in other directions optimized to fill in the thin regions of the bow-tie shape. The result is a panel with increased strength and substantially uniform wall thickness.

23 Claims, 15 Drawing Sheets

U.S. PATENT DOCUMENTS 5,256,004 A 10/1993 Gemmi et al. ..... 405/237
5,341,882 A * 8/1994 Hale ..... 405/128
5,542,782 A * 8/1996 Carter, Jr. et al. ..... 405/267
5,591,118 A * 1/1997 Bierck ..... 405/128
5,758,993 A 6/1998 Schmednecht et al. ..... 405/267
5,765,965 A 6/1998 Carter, Jr. et al. ..... 405/129
5,789,649 A * 8/1998 Batchelor et al. ..... 405/263
5,816,748 A * 10/1998 Kleiser et al. ..... 405/268
5,819,850 A * 10/1998 Lee, Jr. et al. ..... 175/21
5,836,390 A * 11/1998 Apps et al. ..... 405/263
5,860,907 A * 1/1999 Kauschinger ..... 405/269
5,884,715 A * 3/1999 Reddoch ..... 405/128
6,053,666 A * 4/2000 Irvine et al. ..... 405/279
6,120,214 A * 9/2000 Iovino ..... 405/241

* cited by examiner

METHOD AND APPARATUS FOR CONSTRUCTING AN UNDERGROUND BARRIER WALL STRUCTURE

FEDERALLY SPONSORED RESEARCH

The United States Government has rights in this invention pursuant to Department of Energy Contract No. DE-AC04–94AL85000 with Sandia Corporation.

CROSS-REFERENCE TO RELATED APPLICATIONS

Not Applicable

BACKGROUND OF THE INVENTION

This invention relates generally to the field of containment of underground hazardous wastes and more specifically to a method and apparatus for constructing an underground barrier wall structure using a jet grout injector subassembly comprising a pair of primary nozzles and a plurality of secondary nozzles, the secondary nozzles having a smaller diameter than the primary nozzles, for injecting grout in directions other than the primary direction, which creates a barrier wall panel having a substantially uniform wall thickess.

An important goal of environmental remediation is reducing or preventing underground hazardous wastes from migrating outside of contaminated sites. Examples of hazardous wastes include pesticide contaminated groundwater, benzene vapors, or non-aqueous phase liquids, such as gasoline leaking from a buried storage tank. An underground structure, such as a barrier wall, can be used to contain or redirect the flow of groundwater contaminated with hazardous wastes. A barrier wall is typically made of a substantially impermeable material that prevents the flow of these hazardous materials through the relatively permeable surrounding ground (soil, sand, etc.). Cement-based grout (a well-known mixture of Portland cement, sand, and water), sometimes mixed with the surrounding soil, is commonly used as a ground-hardening material to fabricate impermeable underground barrier walls.

Alternatively, the underground barrier wall can be constructed of materials that include permeable reactive materials (PRM's). As the hazardous wastes flows through the permeable barrier wall, the wastes are removed, captured, or modified by the action of various active agents contained within the PRM's. The PRM's react with the hazardous wastes by chemical, physical, or biological processes, or combinations of these. Treated groundwater is then returned to the aquifer.

Underground barrier walls can be fabricated in-situ by jet grouting. The term "jet grouting" refers to the use of high-pressure jet spray nozzles, which are located on an injector subassembly attached to the end of a drill string, to inject a slurry of material at relatively high velocity into the surrounding soil. The jet spray simultaneously masticates and erodes the surrounding soil, while mixing the loosened soil with the injected slurry to form a soil/slurry mixture that replaces the eroded cavity. If the slurry is primarily made of grout then the mixture of soil and grout subsequently hardens into a solid, substantially impermeable material (sometimes called "soilcrete"). If the slurry contains PRM's, then the mixture of soil and slurry forms a permeable reactive barrier wall.

In this application, the term "soil" is broadly defined to include any mixture of soil, sand, clay, gravel, organic materials, or other granular materials, either naturally occurring or man-made, which can be loosened and eroded by the action of the jet spray. The phrase "jet grouting" is broadly defined to include injection of slurries containing (1) grout or other ground-hardening materials; or (2) permeable reactive materials (PRM's). The terms "slurry" and "grout" is herein broadly defined to include mixtures of solid materials with any liquid, including water; and with any gases, including air. The terms "slurry" and "grout" also comprehends 0% of solid materials, including: (1) injection of only liquids; (2) liquids plus gases; (3) gases only; (4) or any combination of solids, gases, and liquid that can be injected from a spray nozzle, e.g. "jet grouted". In this application, the terms "slurry" and "grout" are used interchangeably, as defined herein above.

Jet grouting typically occurs when the drill string is being withdrawn from the drill hole. If the jet injector subassembly is not rotated during withdrawal, then the jet spray creates a thin "diaphragm wall". The injection of "grout" as it was broadly defined earlier, from each jet nozzle, as the nozzle is removed from a single hole, acts to create its own thin diaphragm wall segment. The number of segments equals the number of jet nozzles. For example, operation of two jet nozzles would result in two panels. Each segment is connected to each other segment by grout which is deposited and fills up the central void space left when the drill string is removed from the drill hole.

The jet injector subassembly traditionally has only two nozzles (e.g. orifices) that typically that face outwards in diametrically opposite (e.g. 180 degrees opposed) directions. Nozzle diameters typically vary from 2 to 3 mm, but can be larger, or smaller. The slurry is injected at high pressures (up to 6000 psi) through these two nozzles, in a direction radially outward from the center of the subassembly. As illustrated in FIG. 1, the high velocity jet spray creates a panel whose width, $R_{max}$, is greater than the panel's maximum thickness, $T_{max}$. Depending on the soil conditions, $R_{max}$ can be at least 2 meters; the maximum thickness $T_{max}$ can be at least 20–30 cm; and the minimum thickness $T_{min}$ can be at least 8–10 cm.

An interconnected barrier wall can be made by drilling a second hole close to the first one and repeating the jet grouting process, as many times as necessary to provide adequate coverage. FIG. 2 illustrates a series of interconnected thin diaphragm wall panels using this technique. Typical distances between adjacent holes are 1–3 meters, but can be larger or smaller depending on the soil conditions and requirements.

Conventional jet grouting processes that use only two (non-rotating) nozzles create barrier walls that have a non-uniform wall thickness. This results because the natural shape formed by a jet spray is an expanding cone. Consequently, when two nozzles inject slurry from diametrically opposed positions, a "bow-tie" shape results. The "bow-tie" shape can be seen in FIGS. 1 and 2.

The problem with this "bow-tie" shape is the thin, weak region located directly adjacent to the drill hole. This thin region is more prone to cracking, separating, and/or tearing than the thicker region at the end of the jet spray. Cracking may be caused by non-uniform shrinkage of the solidifying grout or surrounding media. Also, the thin region may have a non-optimum mixture of grout plus soil, when compared to the thicker region at the end of the jet spray. FIG. 3 shows that cracking of the thin section can create uncontrolled leakage of hazardous wastes, thereby defeating the integrity of the containment barrier.

The problem of weakness associated with the bow-tie shape is also present in permeable reactive barrier walls constructed of permeable reactive materials (PRM's). Any large differences in the wall thickness of a porous reactive barrier wall ($T_{max}$>>$T_{min}$) would likely result in non-uniform rates of waste treatment, and non-optimum utilization of the PRM's. Likewise, cracking or tearing of the porous reactive barrier wall would reduce the overall effectiveness of the waste treatment process because untreated wastes could flow directly through the cracked region.

A need remains, therefore, for a simple and easily deployable solution to the problem of weakness and non-uniform thickness caused by the bow-tie shape associated with jet grout injection using conventional dual-nozzle technology. Against the background just described, the present invention solves this problem by using at least four additional secondary nozzles to simultaneously fill in the thin, weak region by injecting slurry in directions other than the pair of diametrically-opposed primary nozzles. FIG. 4 shows that this method produces a filled-in zone, 72, that creates an optimum underground barrier wall structure having a substantially uniform wall thickness. Throughout this application, the phrase "substantially uniform" means that the variations in the wall's actual thickness are small when compared to the wall's average thickness.

BRIEF SUMMARY OF THE INVENTION

The present invention is a method and apparatus for constructing underground barrier walls having a substantially uniform wall thickness. The apparatus has at least four secondary nozzles, of a smaller diameter than the primary nozzles, located on either side of the two primary nozzles. Slurry is injected simultaneously through the secondary nozzles in directions other than the primary direction in such a way that the thin regions of the bow-tie shape are filled in. The number, size, and location of the secondary nozzles are optimized depending on the soil and slurry properties. The secondary nozzles have a smaller diameter so that the flow and velocity of injected slurry is less than the spray of slurry from the primary nozzles. The lower velocity from the secondary nozzles reduces the depth of penetration. The smaller depth of penetration permits the thin region to be filled-in with a minimum additional amount of slurry, thereby maximizing efficiency. The result, shown in FIG. 4, is a panel having a substantially uniform wall thickness.

The injected slurry may include mixtures of solids, liquids, and gases, depending on the specific desired effect. Examples of ground-hardening that subsequently harden into a substantially impermeable barrier include: grout (a mixture of cement, sand, and water); and mixtures of grout with soil, sand, gravel, bentonite clay, fly ash, ground granulated blast furnace slag, or natural clay. Chemical additives can be added to either accelerate or slow down the hardening process. Air, or other gases, can be added to the mixture to modify the performance under different environments, such as freezing temperatures.

Many different methods can be used inside a porous reactive barrier wall to treat hazardous wastes, including: (1) Chemical Precipitation; (2) Oxidation-Reduction Reactions; (3) Zero-Valent Metal Dehalogenation (e.g. granular iron); (4) Biological Degradation Reactions; (5) Sorption of Organics; and (6) Sorption of Inorganics. Some examples of permeable reactive materials include activated carbon, zeolites, and granular iron.

The jet injector subassembly is attached to the end of a drill string and lowered into a hole in the ground. The injected slurry is supplied to the subassembly at a high pressure (up to about 6000 psi). After insertion, the drill string is slowly withdrawn, without rotation, from the hole while slurry is discharged simultaneously from both primary and secondary nozzles. The jet sprays simultaneously masticate and erode the surrounding soil and mixes the injected slurry with the eroded soil, whereby a thin diaphragm wall of substantially uniform wall thickness is formed. Next, the drill string and injector subassembly is removed, repositioned, and reinserted into an adjacent hole, whereupon the entire process is repeated.

The location of the adjacent hole is chosen advantageously so that the edges of the panels touch each other to form an interconnected underground barrier wall system. The planar orientation of each adjacent thin diaphragm wall panel can either be oriented substantially parallel to, and in-line with, the adjacent panel; or alternatively angled back-and-forth to form a folded, accordion-like wall structure, while continuing to touch the edges of each panel with each other.

A substantially uniformly thick wall thereby prevents the problems of cracking associated with the thin region of the bow-tie shape associated with conventional dual-nozzle techniques.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

The present invention is a method and apparatus for constructing underground barrier wall panels and structures having a substantially uniform wall thickness. This invention solves the problem of the thin, weak regions of the "bow-tie" shape that is formed during conventional jet grout injection when only a pair of diametrically opposed nozzles are used. The present apparatus has at least four secondary nozzles, of a smaller diameter, located on both sides of a pair of diametrically opposed primary nozzles. A slurry of grout or permeable reactive materials (PRM's) is simultaneously injected through each nozzle. The secondary nozzles inject slurry in directions other than the primary direction to fill in the thin, weak regions of the bow-tie shape. The number, size, and location of the secondary nozzles depend on the soil conditions and other factors. The result is a barrier wall panel having a substantially uniform wall thickness.

Figure 1:
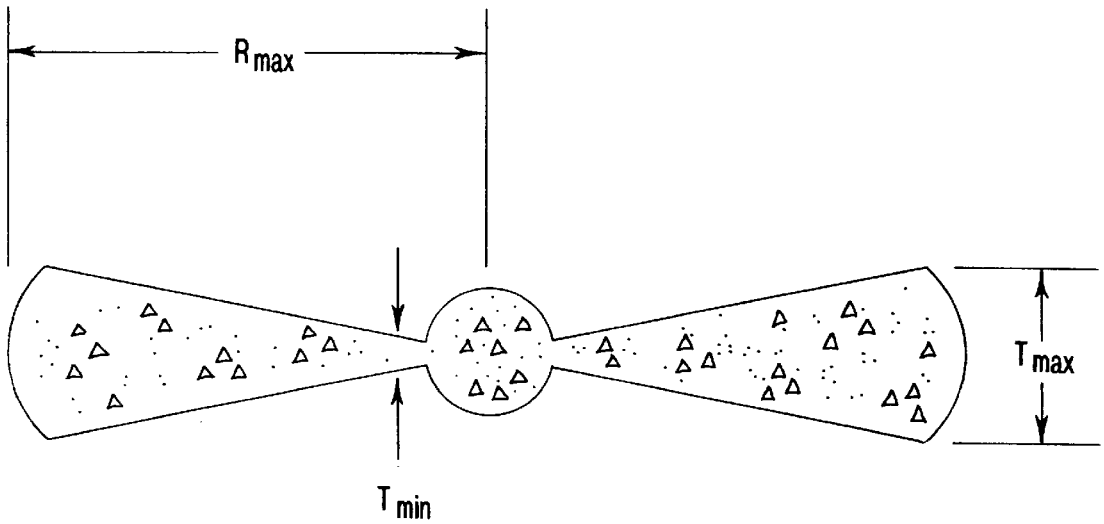
FIG-1 (PRIOR ART)
FIG. 1 (prior art) shows a plan view of conventional jet grout injector subassembly with a pair of diametrically opposed primary nozzles. Shape of the injected grout looks like a "bow-tie".
Figure 2:
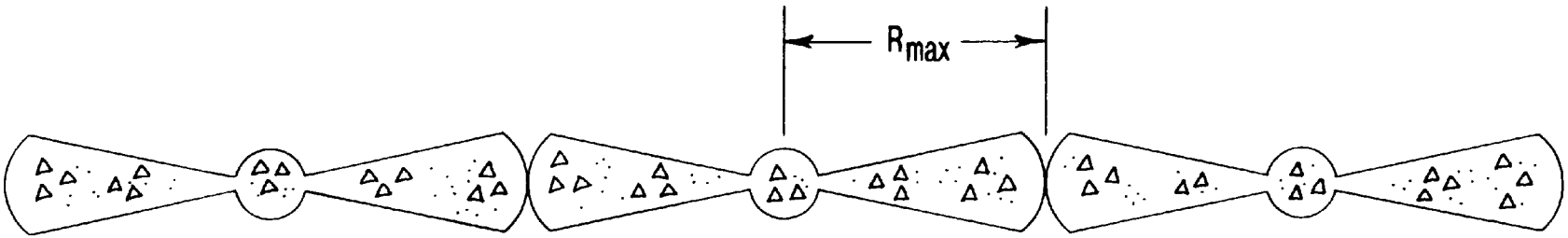
FIG-2 (PRIOR ART)
FIG. 2 (prior art) shows a plan view of multiple conventional vertical interconnected thin diaphragm wall panels forming an underground barrier wall.
Figure 3:
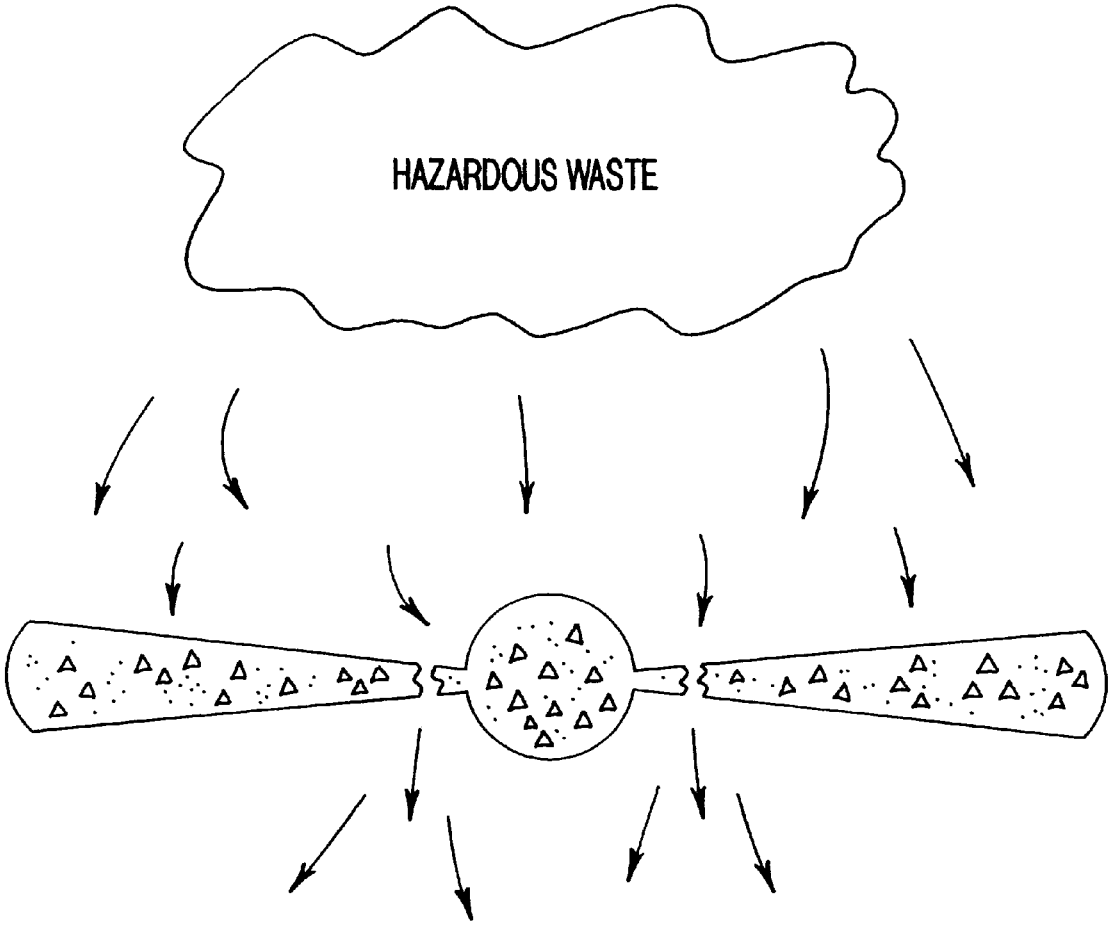
FIG-3 (PRIOR ART)
FIG. 3 (prior art) shows a plan view of conventional bow-tie jet grout panel showing cracks in thinnest wall sections adjacent the central core, permitting leakage of hazardous waste through cracks.
Figure 4:
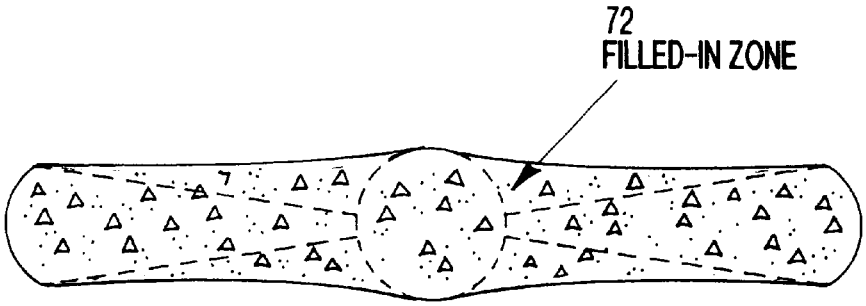
FIG. 4 shows a plan view of jet grout panel geometry made by the present invention by filling in the thin regions next to the central hole with additional grout injected through secondary nozzles. Final shape is substantially uniform, with a nearly constant thickness and no thin regions.
Figure 5:
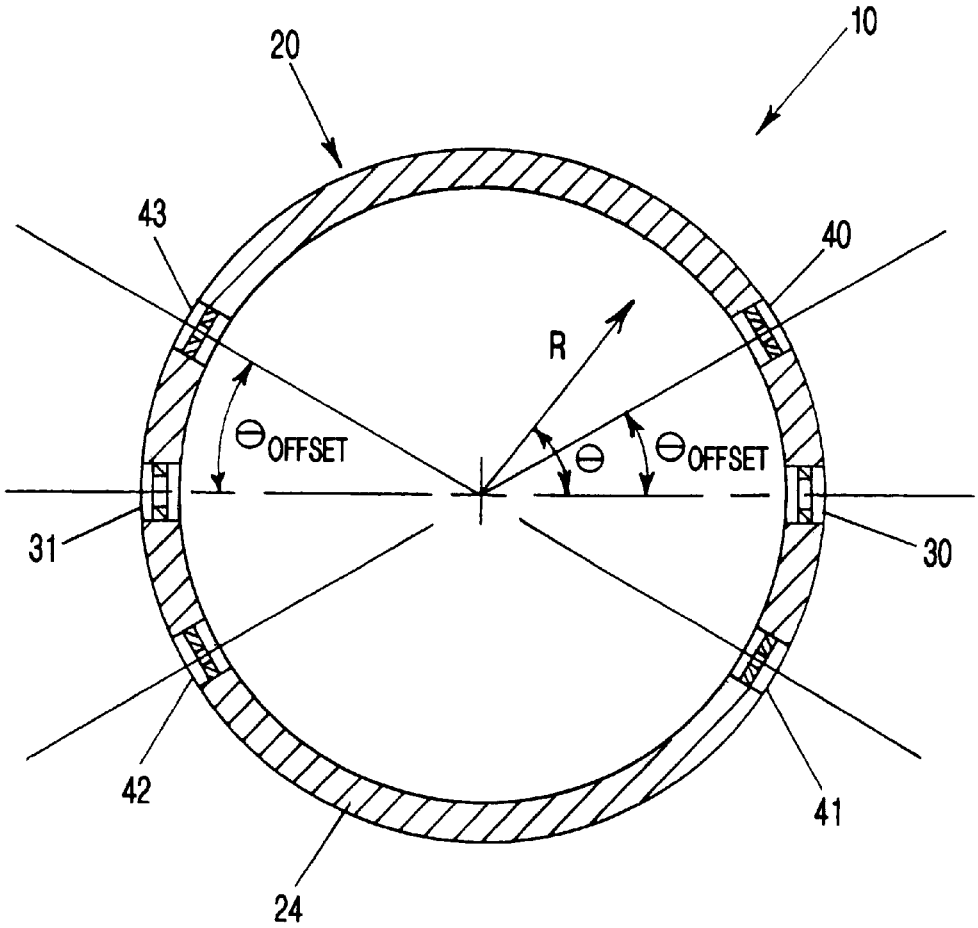
FIG. 5 shows a plan cross-section of jet grout injector subassembly showing two primary nozzles and four secondary nozzles.

FIG. 5 shows a preferred embodiment of the apparatus, in a cross-sectional plan view, cut perpendicular to the longitudinal axis. The jet grout injector subassembly 10 comprises a hollow cylinder 20 having a pair of primary nozzles 30 and 31 and four secondary nozzles 40, 41, 42, and 43. A conventional cylindrical coordinate system (r, θ, z) is used to describe the location of the nozzles. The radial coordinate, r, has it's origin at the center of hollow cylinder 20. The circumferential angle, θ, defines the circumferential position around cylinder 20 in a counter-clockwise direction. The axial position, z, defines the position along the longitudinal axial coordinate (e.g. axis) of cylinder 20.

FIG. 5 shows a first primary nozzle 30, having an inside diameter equal to $D_p$, that penetrates wall 24 of hollow cylinder 20 at a circumferential angle equal to zero degrees and at an axial location z equal to zero. $D_p$ is defined as the inside diameter of the orifice of a primary nozzle, through which slurry is injected. The position of first primary nozzle 30 defines the location where both z and θ are equal to zero. A second primary nozzle 31 also having a inside diameter equal to $D_p$ penetrates wall 24 at a circumferential angle approximately equal to 180 degrees, e.g. diametrically opposed to first primary nozzle 30.

We define a numerical constant, the circumferential offset angle, $\theta_{offset}$, where $\theta_{offset}$ is greater than zero degrees, but less than 90 degrees. This numerical constant is used to define the circumferential position of the secondary nozzles relative to the position of the primary nozzles, via the circumferential angle coordinate system, θ. The optimum value of $\theta_{offset}$ and the nozzle diameters depends on the specific application, soil type, slurry type, and other similar factors.

FIG. 5 shows a first secondary nozzle 40 having an inside diameter equal to $D_s$ that penetrates wall 24 at a circumferential angle approximately equal to $\theta_{offset}$. $D_s$ is defined as the inside diameter of the orifice of a secondary nozzle, through which slurry is injected. A second secondary nozzle 41 having an inside diameter equal to $D_s$ penetrates wall 24 at a circumferential angle equal to $-\theta_{offset}$ A third secondary nozzle 42 having an inside diameter equal to $D_s$ penetrates wall 24 at a circumferential angle approximately equal to $180+\theta_{offset}$. A fourth secondary nozzle 43 having an inside diameter equal to $D_s$ penetrates wall 24 at a circumferential angle approximately equal to $180-\theta_{offset}$.

The inside diameter $D_p$ of the primary nozzles is larger than the inside diameter of the secondary nozzles, $D_s$. As explained below, this is a necessary condition so that the secondary nozzles can efficiently fill in the thin regions of the bow-tie shape without wasting excess slurry. Additional pairs of secondary nozzles can be added, as necessary, depending on the application.

Figure 6:
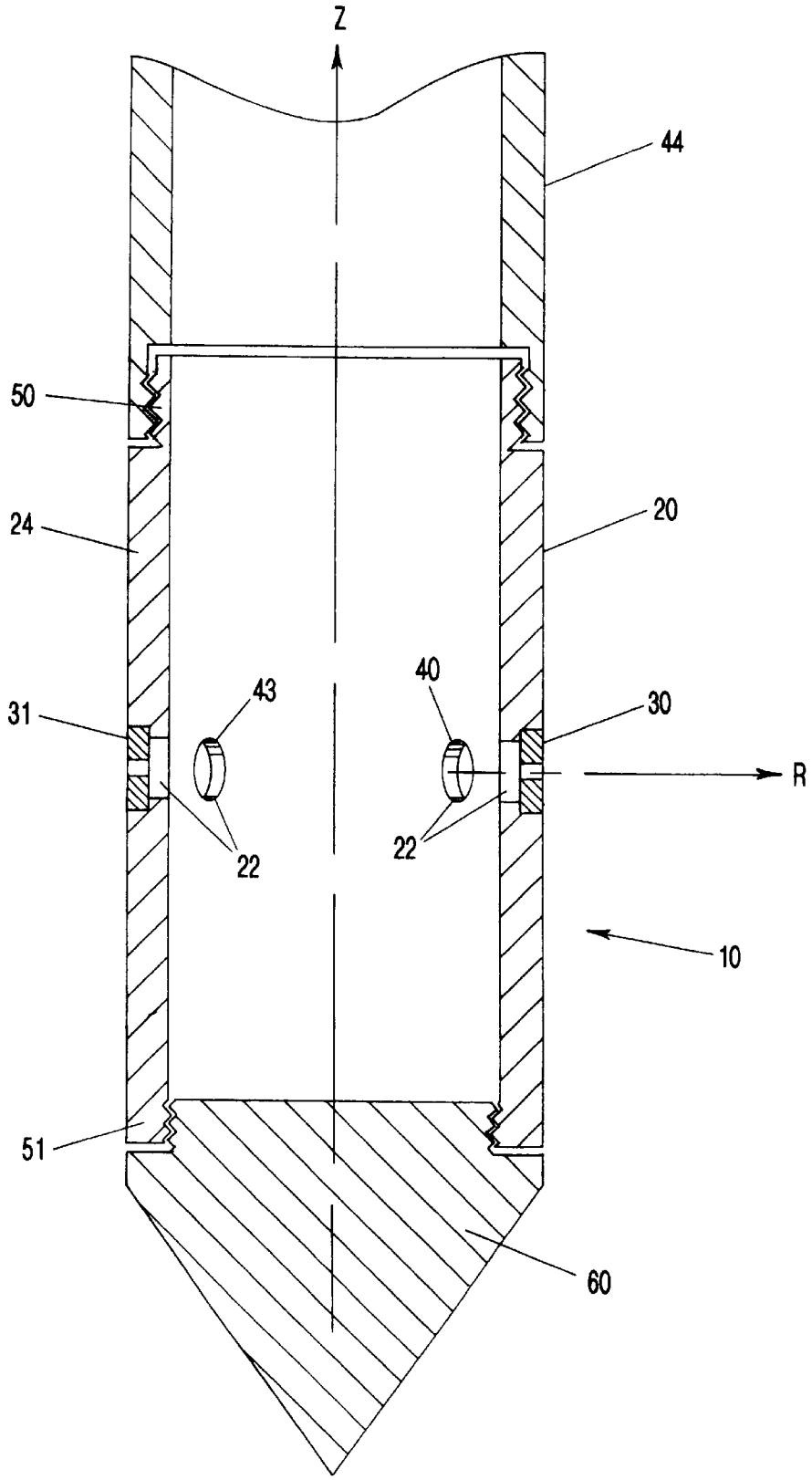
FIG. 6 shows an elevation cross-section of jet grout injector subassembly attached to end of a drill string.

FIG. 6 shows an elevation cross-sectional view of jet grout injector subassembly 10. Cylinder 20 is removeably attached to the distal end of a cylindrical supply pipe 44. Cylinder 20 has an open upper end 50 that communicates with supply pipe 44 and a closed lower end 51. Closed lower end 51 can have a shape that includes a flat end, or a pointed, conical shape to permit easier insertion of subassembly 10 down the drill hole, as shown in FIG. 6. Closed lower end 51 can be integrally made (e.g. continuous) with the body of cylinder 20, or can comprise a seperately-attached end piece 60. Means for attaching end piece 60 to hollow cylinder 20 include a removable threaded connection, as well as permanent methods, such as welding or brazing.

A plurality of threaded holes 22 penetrate wall 24 of cylinder 20. Primary nozzles 30, 31 and secondary nozzles 40, 41, 42, and 43 are removeably inserted into these holes. Slurry is sprayed from primary nozzles 30, 31 and secondary nozzles 40,41,42, and 43 in a radially outward direction, oriented substantially perpendicular to the longitudinal axis of hollow cylinder 20. In this embodiment, both sets of primary and secondary nozzles are located at substantially the same axial position along the longitudinal axis of hollow cylinder 20.

Figure 7:
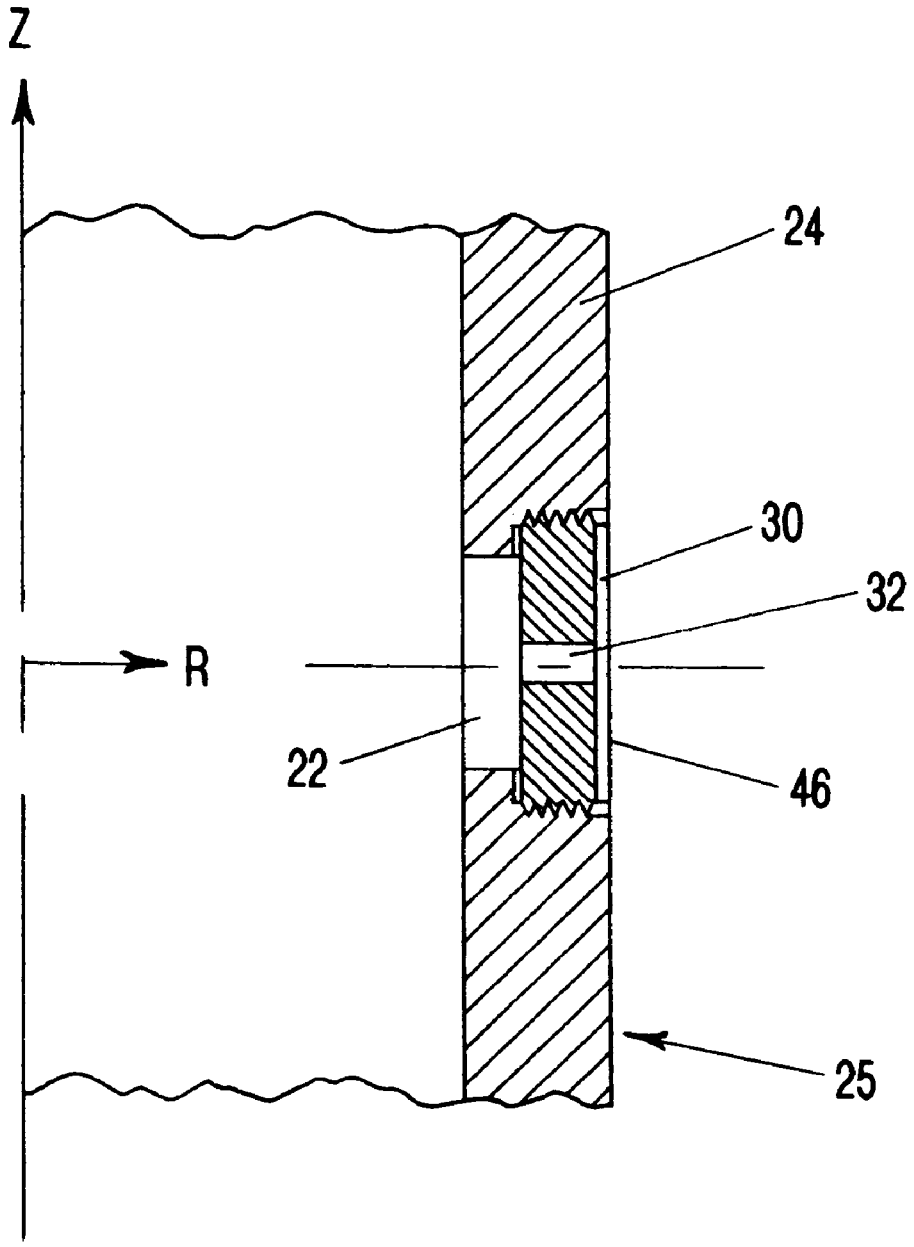
FIG. 7 shows an elevation cross-section view of a removable nozzle inserted into hollow cylinder wall of a jet grout injector subassembly.

FIG. 7 shows an enlarged view of an individual nozzle. To facilitate easy insertion and removal of the jet grout injector subassembly 10 from the drill hole, it is important that the outside-facing surface 46 of any nozzle does not protrude radially beyond the outside surface 25 of cylinder 20. The inside diameter 32 of nozzles 30, 31, 40, 41, 42, and 43 typically range from 1–3 mm, but can be larger or smaller, depending on the application. The nozzles are preferably removable for maintenance, and can be attached via a threaded connection, retainer ring, or other removeable method commonly used in the art. Alternatively, the nozzles can be permanently attached, such as by brazing or welding. The inside walls 32 of the nozzle orifice are shown in FIG.

7 as being straight and parallel, but could also be curved, diverging, or converging, depending on the specific requirement of the jet spray pattern.

Figure 8:
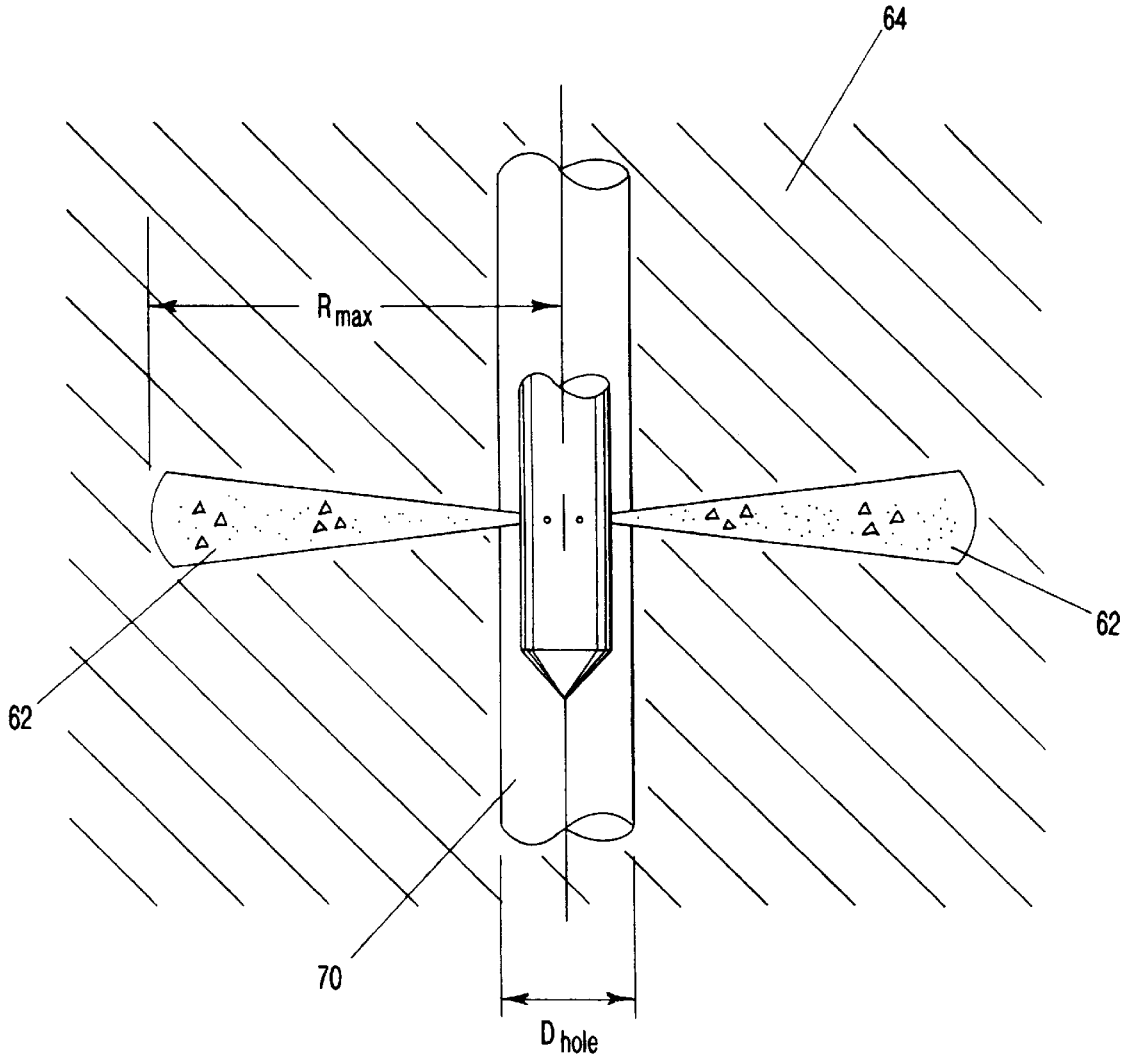
FIG. 8 shows an elevation view of underground hole containing a conventional jet grout injector subassembly.

FIG. 8 shows primary nozzles 30 and 31 injecting a slurry 62 at high pressure and high velocity into the adjacent soil 64 to a depth, $R_{max}$, which is greater than the diameter, $D_{hole}$, of drill hole 70. The primary jet grout spray 62 simultaneously masticates and erodes the surrounding soil 64, while also mixing the soil with injected slurry 62, and filling the eroded cavity with the soil/slurry mixture. The action of the spray exiting the secondary nozzles is purposely not shown in FIG. 8 in order to simplify the drawing.

Figure 9:
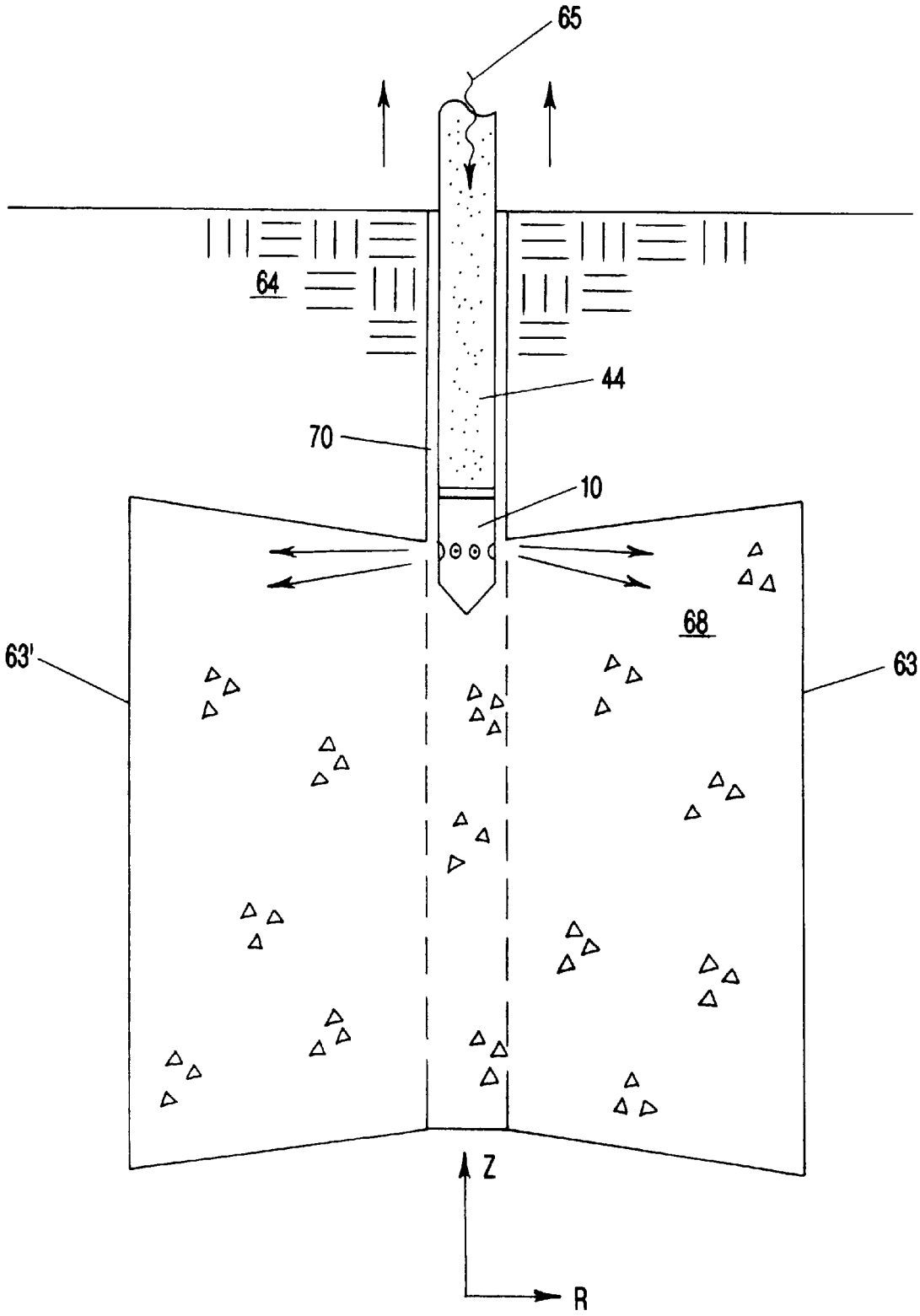
FIG. 9 shows an elevation view of underground thin diaphragm wall panel formed during withdrawal of drill string.

FIG. 9 shows a thin diaphragm wall panel 68 having two edges 63 and 63' that is formed during withdrawal, without rotation, of jet grout injector subassembly 10 from drill hole 70.

Figure 10A:
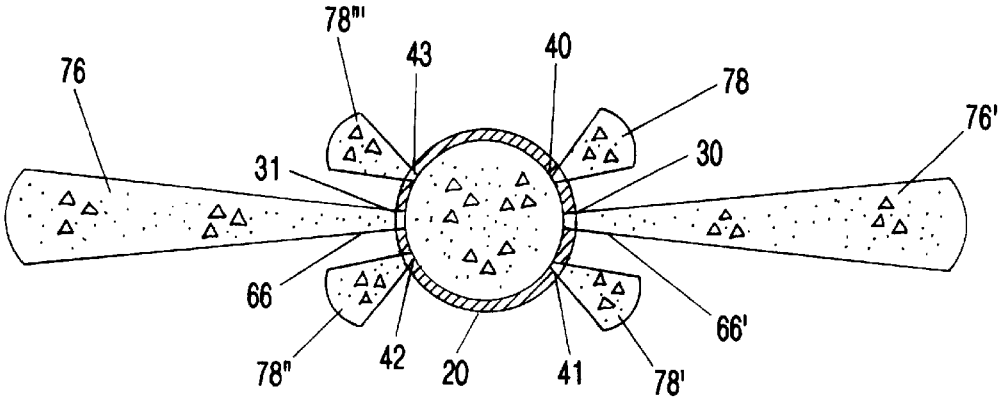
FIG. 10*a* shows a plan cross-section view of jet grout injector subassembly illustrating regions of jet spray.
Figure 10B:
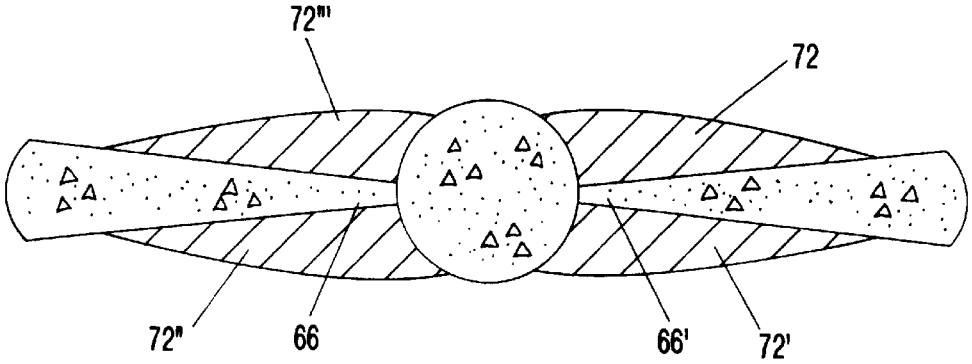
FIG. 10*b* shows a plan cross-section section view showing filled-in region made by secondary nozzles.
Figure 10C:
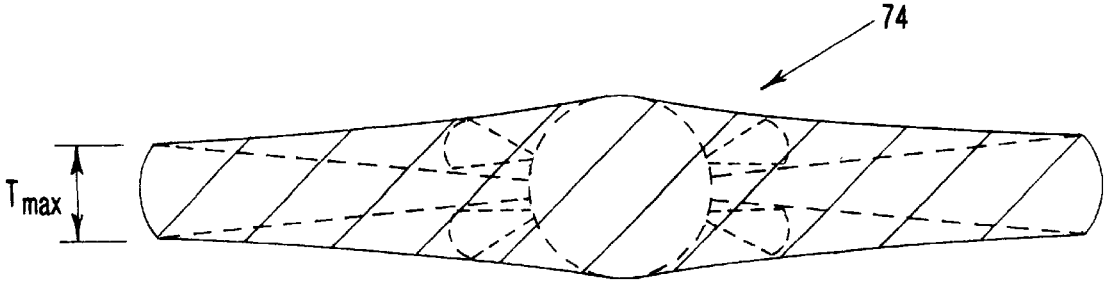
FIG. 10*c* shows a plan cross-section section view of thin diaphragm wall having a nearly uniform wall thickness, with no thin regions.

FIGS. 10*a*, 10*b*, and 10*c* illustrate the process of using secondary nozzles 40, 41, 42, and 43 to construct a barrier wall panel having a substantially uniform wall thickness. Primary nozzles 30 and 31 inject slurry into the cone-shaped shaped primary zones 76 and 76'. The thinnest region 66 and 66' of the "bow-tie" shaped primary zone 76, which is most susceptible to cracking, is identified in FIG. 10*a*. Secondary nozzles 40, 41, 42, and 43 simultaneously inject (e.g. at the same time as slurry is injected by the primary nozzles) slurry into the smaller, cone-shaped secondary zones 78, 78', 78", 78'" that are located on both sides of the primary zones 76 and 76'. In this example, the circumferential offset angle $\theta_{offset}$=30 degrees. Since the inside diameter of the secondary nozzles 40, 41, 42, and 43 are smaller than the inside diameters of the primary nozzles 30, 31, the width and depth of the secondary cone-shaped zones 78, 78', 78", 78'" are correspondingly smaller.

FIG. 10*b* shows that the secondary nozzles 40, 41, 42, and 43 have injected slurry into the adjacent areas 72, 72', 72", 72'" surrounding the thin regions 66 and 66', where areas 72, 72', 72", 72'" are now illustrated as continuous regions.

FIG. 10*c* shows the final cross-section of the barrier wall panel 74 after the slurry and soil have been mixed together. This process produces a wall 74 having a substantially uniform wall thickness, nearly equal everywhere to $T_{max}$, without any thin spots.

Any combination of secondary nozzles 40, 41, 42, and 43 can be used to create the desired goal of eliminating the thin, weak regions 66, 66' in the bow-tie shape. The exact location, number, and size of the secondary nozzles 40, 41, 42, and 43 depends critically on the geomechanical properties of the surrounding soil, including density, strength, porosity, and other similar properties.

Figure 11:
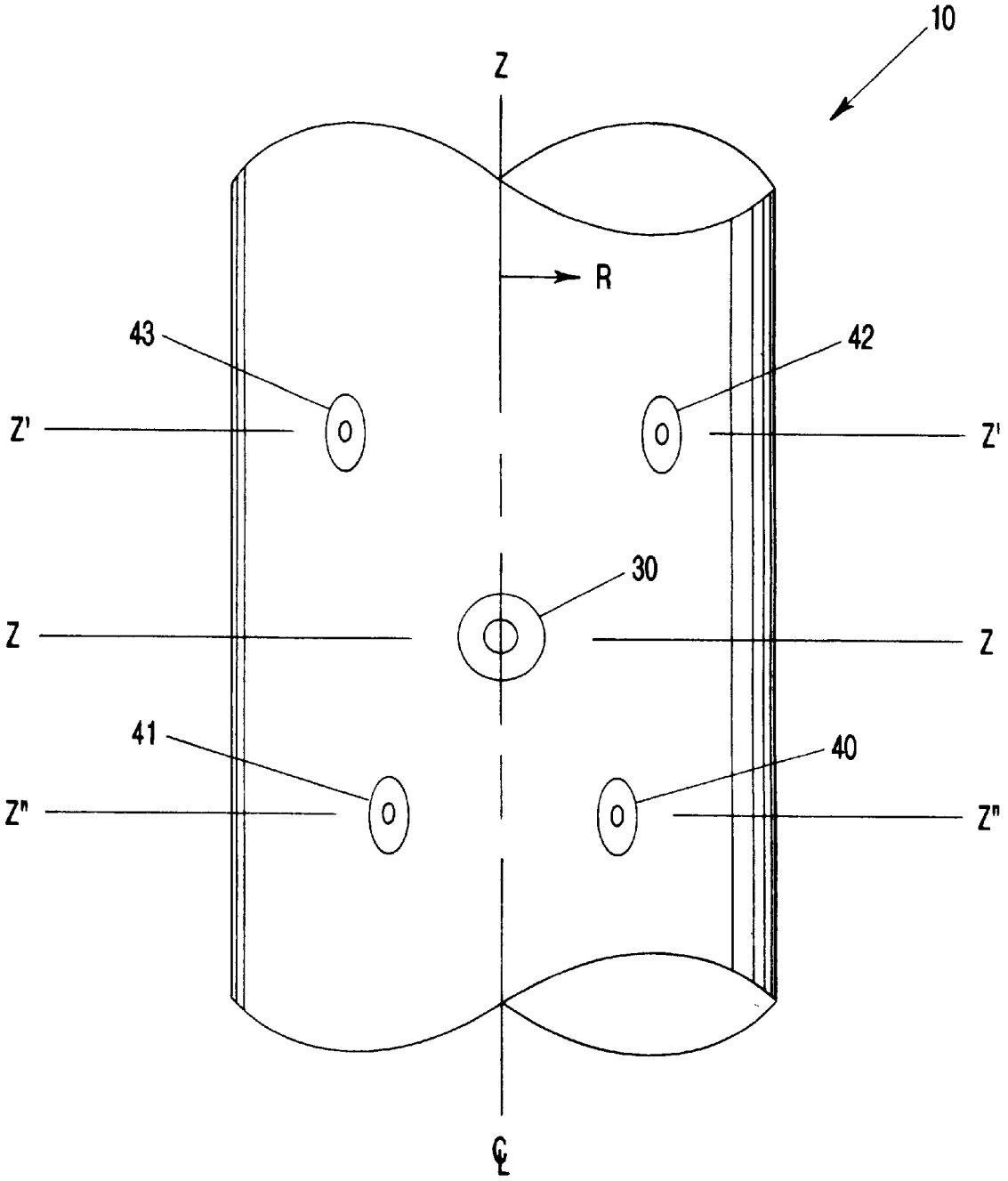
FIG. 11 shows an elevation view of jet grout injector subassembly.
Figure 12:
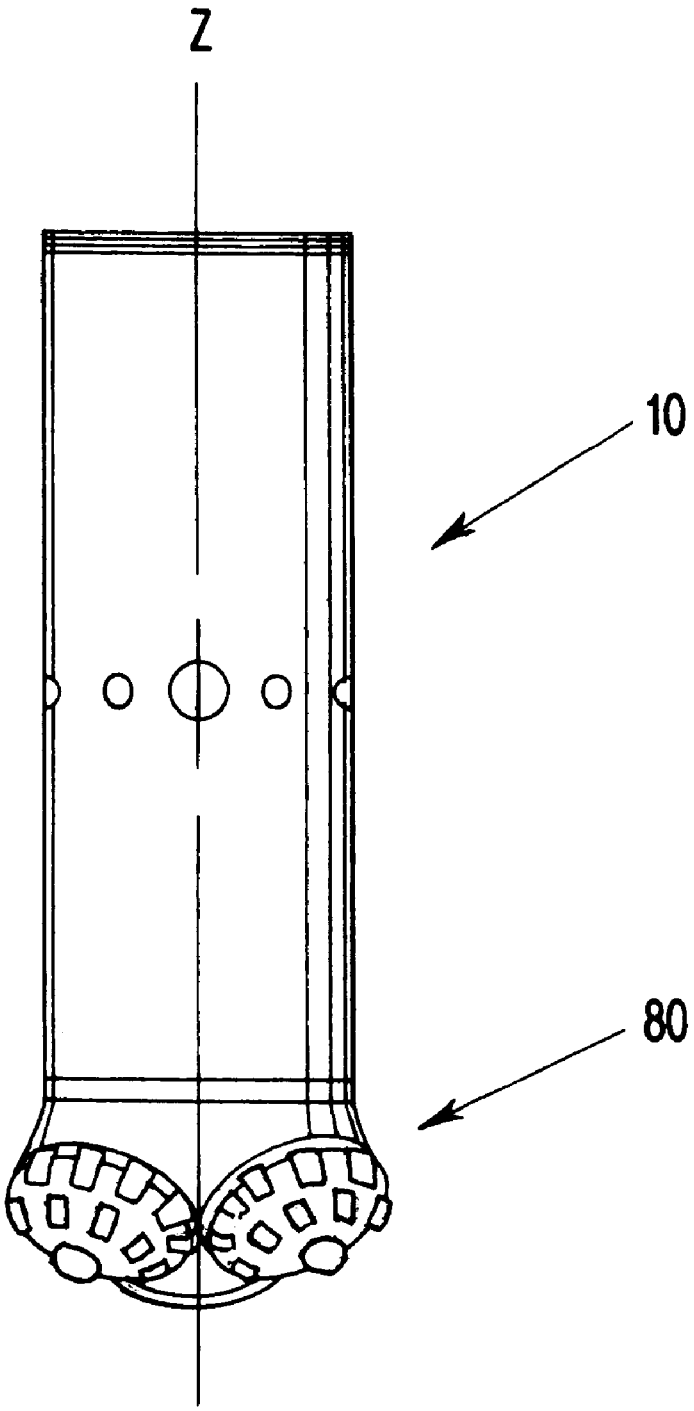
FIG. 12 shows an elevation view of jet grout injector subassembly with attached drill bit.

FIG. 11 shows another embodiment of the invention. Here, secondary nozzles 40, 41, 42, and 43 are located at different axial locations than the primary nozzles 30 and 31. One set of secondary nozzles, 40 and 41 is positioned at axial position Z', while another set, 42 and 43, is positioned at axial position Z". However, all nozzles are still located in a relatively close axial proximity to each other in this embodiment. Here, the term "relatively close" means that the axial distance between the positions Z' and Z" preferably shall not exceed FIG. 12 shows another embodiment of the invention. A drill bit assembly 80 is attached, preferably rernoveably, to the lower end 51 of cylinder 20. In this case, drill bit assembly 80 replaces end piece 60. This replacement allows the individual steps of first drilling the hole, and then jet grouting during withdrawal to be combined into a single step, thereby saving time and costs. In this embodiment, the drill bit assembly 80 drills a hole in the ground while simultaneously carrying the attached jet grout injector assembly down the hole. This embodiment includes means, such as valves, for controlling the flow of drilling fluids, such as drilling mud, to the drill bit assembly, and for controlling the flow of slurry to the jet grout injector subassembly.

In the most general embodiment of this invention, the material injected through the nozzles is any liquid or semi-liquid slurry that is capable of flowing through both primary and secondary nozzles under pressure. In one embodiment, the slurry can be semi-liquid during injection, which subsequently hardens after injection to form a substantially impermeable solid. An example of this type of material is a cement-based grout mixture.

In another embodiment the injected slurry contains, among other things, permeable reactive materials (PRM's). The slurry can include a carrier media (such as water), entrained gases (such as air), inert materials, and one or more active agents. The list of active agents that can be used for permeable reactive barriers is grouped according to their method of treatment, and are discussed below.

Chemical Precipitation

Active agents include slightly soluble materials containing an ion that forms an insoluble salt (such as a phosphate, sulfate, hydroxide, or carbonate metal salts) with the contaminant. Examples include calcium carbonate (limestone), calcium phosphate (hydroxyapatite), gypsum, and hydrated lime.

Oxidation-Reduction Reactions

Treatment media used to change the valence state of an inorganic contaminant, thus reducing solubility and enhancing precipitation, include such reductants as zero-valent metals, hydrogen sulfide, sodium dithionite, and degradable biomass. Also, the strong oxidant potassium permanganate may be used as a possible oxidizing agent for remediation of chlorinated hydrocarbons.

Zero-Valent Metal Dehalogenation

Here the primary active agent is granular iron, which is used to promote reductive dechlorination of chlorocarbons. The reduction step removes chlorine atoms from the chlorocarbon molecule, releasing chloride and ferrous iron into solution. Granular iron plated with copper, palladium, or sulpher-containing compounds can improve the process.

Biological Degradation Reactions

Biological reduction of sulfate to sulfide by sulfate-reducing bacteria can be used to remove metals from mine tailing's water through precipation as insoluble metallic sulfides. Biological denitrification can be used to remove nitrates. Modifying redox conditions can increase the rates of biodegradation of some common aromatic hydrocarbons, such as benzene, ethylbenzene, tolune, and zylenes. Active agents include nitrogen, phosphorus, oxygen, or oxygen release compounds.

Sorption of Organics

Active agents for sorption of organics include granular activated carbon, peat, coal, and organic-rich shales. The capacity of a porous medium to sorb hydrophobic organic solutes may be enhanced by injecting a cationic surfactant solution into the subsurface.

Sorption of Inorganics

Materials suitable for sorbing metals include organic carbon, zeolites, organo-zeolites, aluminosilicate clays, iron/aluminum/manganese oxyhydroxides, and other mineral materials.

Any of the active agent or agents described above could be used alone, or together in combination, as the active component of the slurry used in the construction of a permeable reactive barrier wall panel.

Method of Fabrication

Figure 13A:
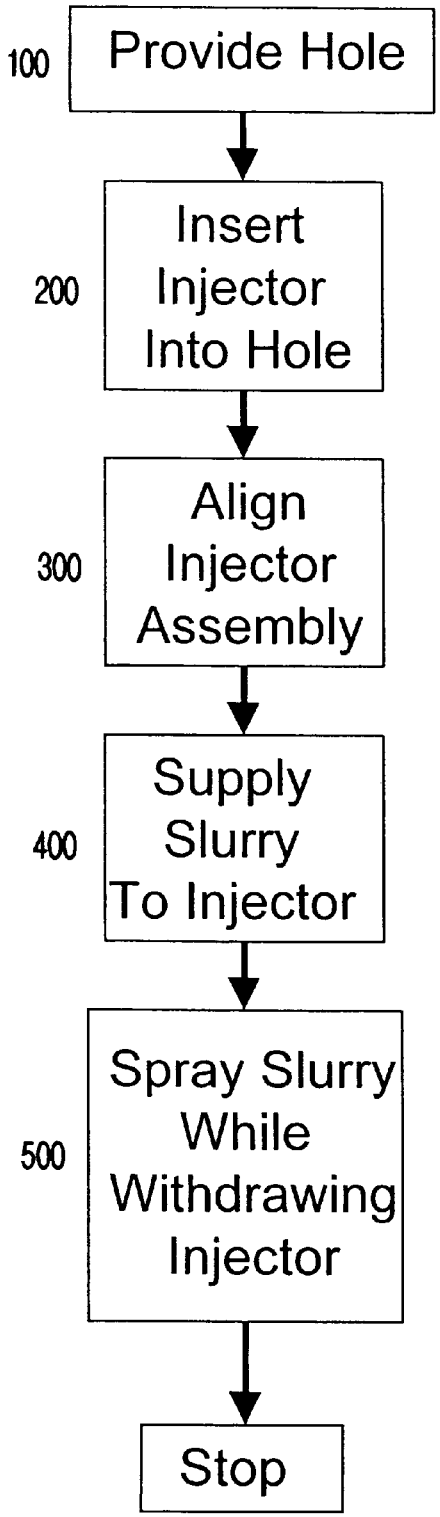
FIG. 13*a* shows a process flow chart for method of jet grouting in a single hole.

FIG. 13*a* illustrates as a block diagram the process of using a jet grout injector subassembly 10 in a single hole. In step 100, a hole in the ground is provided. This may be an existing hole, or a hole drilled by a drill bit assembly attached to the jet grout injector assembly (as described above, and as shown in FIG. 12). In step 200, the jet grout injector subassembly 10 is attached to the end of a drill string and lowered into the hole. In step 300, the jet grout injector subassembly 10 is rotated to properly align the angular orientation of the spray nozzles with respect to the surrounding ground and the location of hazardous wastes. Then, in step 400, slurry (grout or permeable reactive materials) is supplied to the subassembly at a high pressure (up to about 6000 psi). In step 500 slurry is discharged and sprayed simultaneously from all of the nozzles, while the drill string is slowly withdrawn, without rotation, from the hole. The jet sprays simultaneously masticate and erode the surrounding soil, while mixing the injected slurry with the eroded soil. Slurry is sprayed in a direction radially outwards through a pair of primary nozzles to a greater radial depth of penetration, and simultaneously spraying through a plurality of secondary nozzles to a lessor radial depth of penetration, whereby a first barrier wall panel is formed having a substantially uniform wall thickness and having two edges defined by said greater radial depth of penetration of slurry sprayed from said primary nozzles.

Figure 13B:
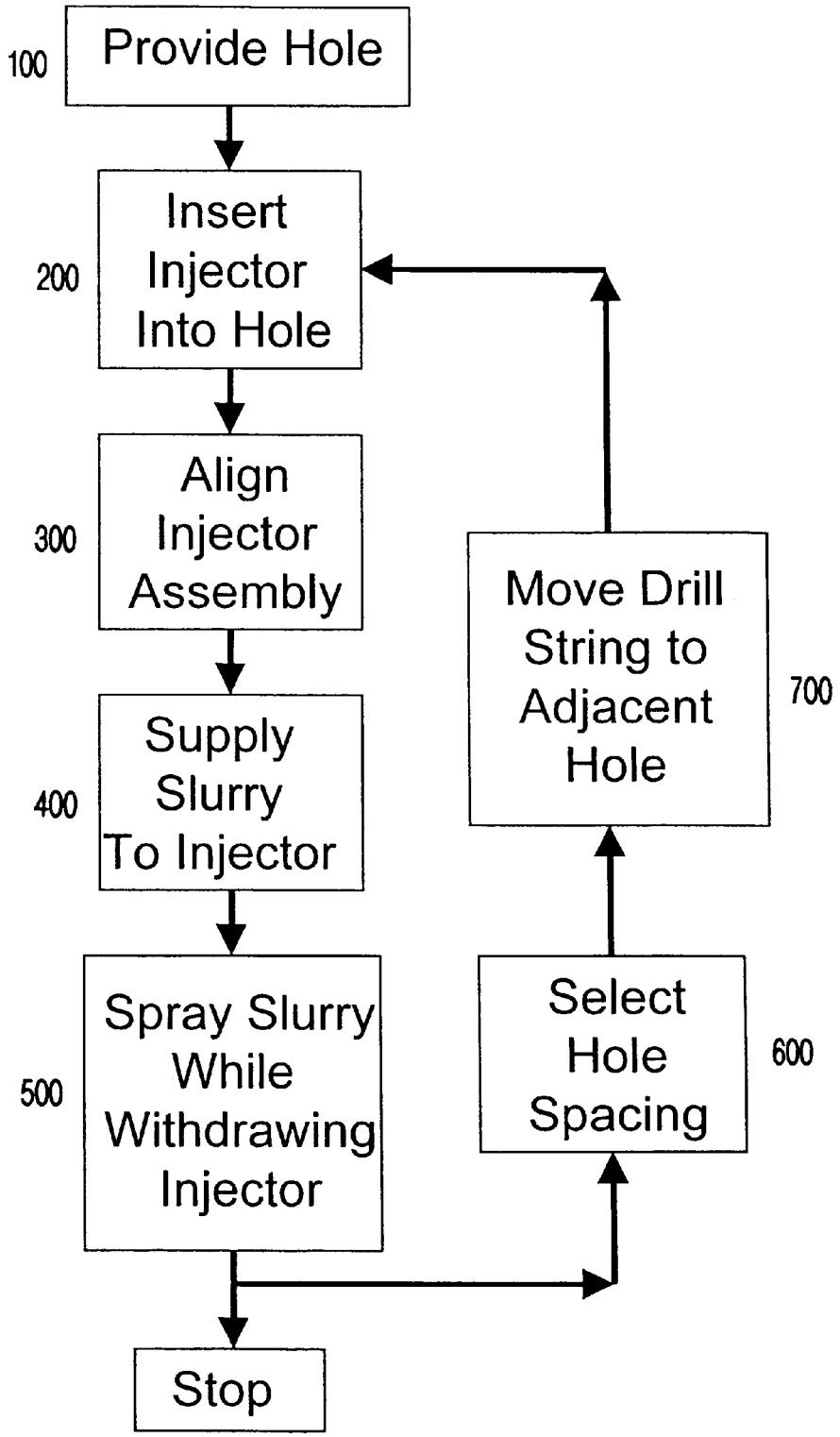
FIG. 13*b* shows a process flow chart for method of jet grouting using multiple holes.

FIG. 13*b* illustrates as a block diagram the process of using a jet grout injector subassembly 10 in multiple adjacent holes. Steps 100, 200, 300, 400, and 500 are the same as described above. In step 600, the distance between the two adjacent drill holes, $S_{hole}$, is chosen advantageously so that the edges of the panels approximately touch each other. Next, in step 700 the drill string with attached injector subassembly is removed from the previous hole, and then moved to a new hole, which located adjacent to the previous hole at a distance of $S_{hole}$. Steps 100, 200, 300, 400, and 500 are then repeated. Note that in step 300, the injector subassembly is rotated about its longitudinal axis and realigned so that the primary nozzles assume a proper angular orientation inside the second hole relative to their original position in the first hole. The entire process is repeated as many times as necessary in order to form an interconnected underground barrier wall structure with the desired total number of panels.

Figure 14A:
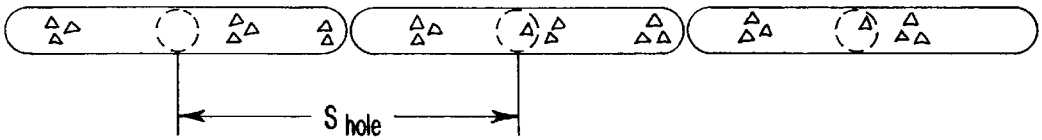
FIG. 14*a* shows a plan view of an underground barrier wall structure formed from multiple, interconnected thin diaphragm barrier wall panels which are aligned to be substantially co-incident with each other, with their edges touching each other.

FIG. 14*a* illustrates that each adjacent barrier wall panel is aligned substantially parallel to, and substantially in-line with, each adjacent panel.

Figure 14B:
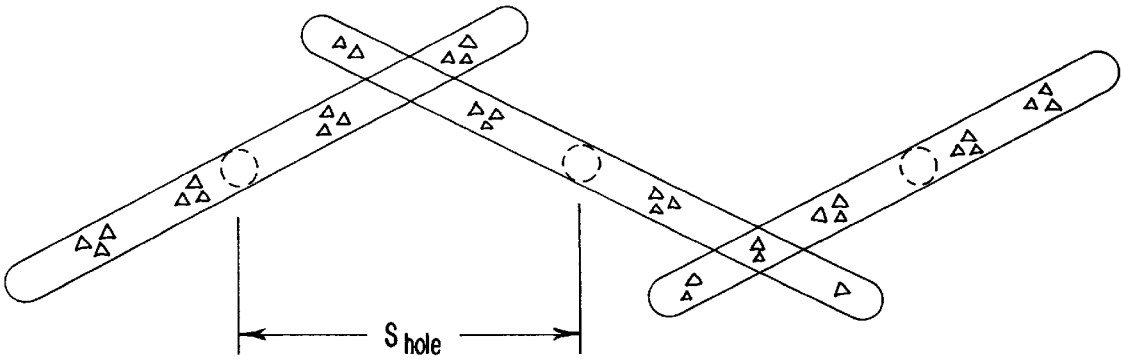
FIG. 14*b* shows a plan view of an underground barrier wall structure alternatively angled back-and-forth to form a folded, accordion-like wall structure with intersecting panels.

FIG. 14*b* shows another embodiment where each panel is alternatively angled back-and-forth to form a folded, accordion-like wall structure. Using this geometry improves the ability to produce a continuous wall structure, because each panel will intersect each adjacent panel even if the centers of each hole do not exactly line up with each other.

Figure 15:
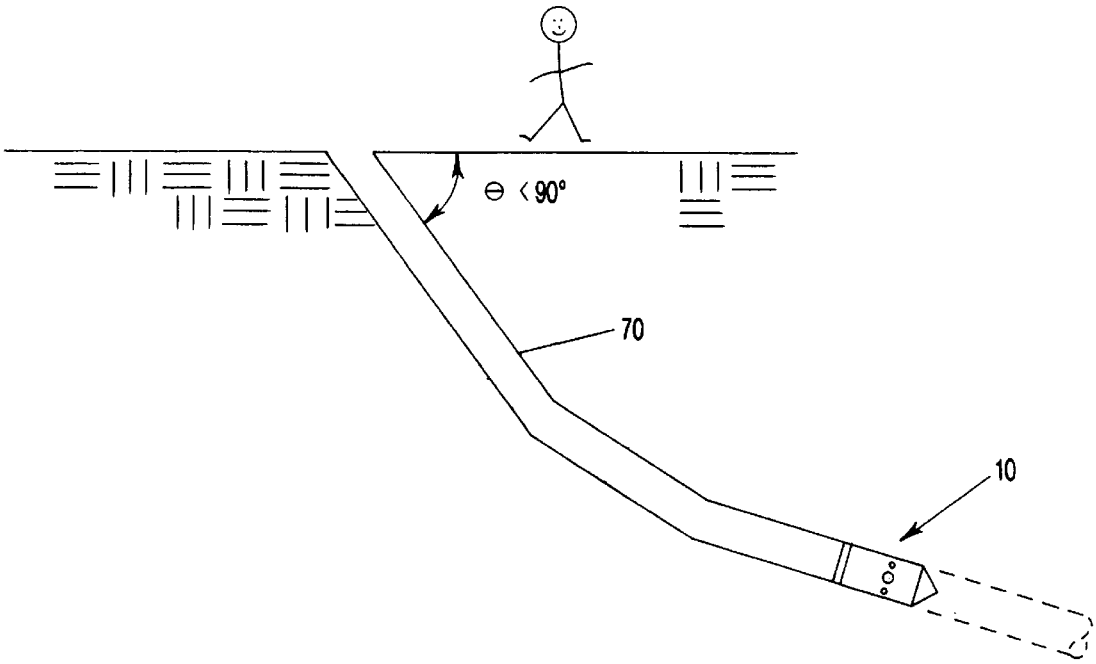
FIG. 15 shows an elevation view illustrating how conventional directional drilling techniques can be used in combination with the present invention to construct an underground barrier wall panel that is angled less than 90 degrees with respect to the ground's surface

FIG. 15 shows that directional drilling techniques can be used in combination with the present invention to construct an underground barrier wall structure that is angled less than 90 degrees with respect to the ground's surface. This is accomplished, in part, by angling drill hole 70 less than 90 degrees with respect to the ground's surface. Alternatively, drill hole 70 can be orientated substantially perpendicular to the ground's surface.

Referring now to the embodiment wherein a drill bit assembly is attached to the end of the jet grout subassembly, the method of using this embodiment includes the following steps. Here, the jet grout subassembly is carried down the hole simultaneously while the drill bit assembly is drilling the hole. Controlling means, such as valves, are used to provide a flow of drilling fluid, such as drilling mud, to the drill bit assembly while the hole is being drilled. After the desired depth is reached, drilling stops, and the flow of drilling fluid is stopped. Then, the controlling means is used to provide a flow of slurry to the jet grout injector subassembly, and jet grouting proceeds as before while the injector subassembly is slowly withdrawn from the hole.

The particular sizes and equipment discussed above are cited merely to illustrate a particular embodiment of this invention. It is contemplated that the use of the invention may involve components having different characteristics. It is intended that the scope of the invention be defined by the claims appended hereto.

DESCRIPTION OF A WORKING EXAMPLE

Testing was conducted to determine an optimal nozzle pattern configuration to produce a structurally sound barrier panel while minimizing the volume of grout used. A mono-fluid jet grouting system was used to construct test grout panels to test eight separate nozzle configurations so that an optimal nozzle pattern can be used to create a higher strength planer cross-section, thus eliminating stress failures.

A nozzle holder subassembly was machined so those nozzles could be placed at the following circumferential positions (in a plan view): 0, 45, 90, 135, 180, 210, 225, 270, 315, and 330 degrees. During the test, the 0 and 180 degree positions were always fitted with 2.2 mm inner diameter primary nozzles. The other positions, when used, were always fitted with 1.5 mm inner diameter secondary nozzles. Unused nozzle positions were plugged. All combinations were tested with exception of those which were redundant (e.g. mirror images).

The test consisted of forming eight separate panels about two feet in height. The top of each panel was about one foot below grade surface. For each panel the drill rod was inserted about three feet below grade surface. Grout pressure was raised to approximately 350 bar (5000 psi) and the drill rod was withdrawn, without rotation, in 6 cm increments with a time delay of 4 seconds per step. Each succeeding test panel had the nozzles reconfigured in accordance with the table shown below. The last panel (number 8) was the control or baseline test, which consisted of the commonly used two-nozzle configuration (e.g. only primary nozzles).

Approximately one week after the test panel installation the test pit area was excavated using a backhoe-loader. Panels 2, 3, and 4 showed the best results. The other panels either used excessive amounts of grout, or were not more structurally sound than panel 8 (the control panel). The nozzle configuration that was used in panel 4 appears to be optimal. This optimum layout configuration for the conditions of this test is shown in FIG. 5, with $\theta_{offset}$=30 degrees.

| Panel Number | Nozzle Position # | Circum-ferential Angle | Nozzle Diameter (mm) | Nozzle area (mm2) | Total Area (mm2) |
|---|---|---|---|---|---|
| 1 | 1 | 0 | 2.2 | | |
| | 7 | 180 | 2.2 | 7.6 | |
| | 9 | 225 | 1.5 | | |
| | 11 | 315 | 1.5 | | |
| | 10 | 270 | 1.5 | | |
| | 3 | 45 | 1.5 | | |

-continued

| Panel Number | Nozzle Position # | Circum-ferential Angle | Nozzle Diameter (mm) | Nozzle area (mm2) | Total Area (mm2) |
|---|---|---|---|---|---|
| | 5 | 135 | 1.5 | | |
| | 4 | 90 | 1.5 | 10.62 | 18.22 |
| 2 | 1 | 0 | 2.2 | | |
| | 7 | 180 | 2.2 | 7.6 | |
| | 12 | 330 | 1.5 | | |
| | 8 | 210 | 1.5 | | |
| | 6 | 150 | 1.5 | | |
| | 2 | 30 | 1.5 | | |
| | 10 | 270 | 1.5 | | |
| | 4 | 90 | 1.5 | 10.62 | 18.22 |
| 3 | 1 | 0 | 2.2 | | |
| | 7 | 180 | 2.2 | 7.6 | |
| | 3 | 45 | 1.5 | | |
| | 5 | 135 | 1.5 | | |
| | 9 | 225 | 1.5 | | |
| | 11 | 315 | 1.5 | 7.08 | 14.68 |
| 4 | 1 | 0 | 2.2 | | |
| | 7 | 180 | 2.2 | 7.6 | |
| | 2 | 30 | 1.5 | | |
| | 6 | 150 | 1.5 | | |
| | 12 | 330 | 1.5 | | |
| | 8 | 210 | 1.5 | 7.08 | 14.68 |
| 5 | 1 | 0 | 2.2 | | |
| | 7 | 180 | 2.2 | 7.6 | |
| | 5 | 135 | 1.5 | | |
| | 11 | 315 | 1.5 | 3.54 | 11.14 |
| 6 | 1 | 0 | 2.2 | | |
| | 7 | 180 | 2.2 | 7.6 | |
| | 12 | 150 | 1.5 | | |
| | 6 | 330 | 1.5 | 3.54 | 11.14 |
| 7 | 1 | 0 | 2.2 | | |
| | 7 | 180 | 2.2 | 7.6 | |
| | 4 | 90 | 1.5 | | |
| | 10 | 270 | 1.5 | 3.54 | 11.14 |
| 8 | 1 | 0 | 2.2 | | |
| | 7 | 180 | 2.2 | 7.6 | 7.6 |

We claim:

1. A jet grout injector subassembly, comprising:

a hollow cylinder comprising an open upper end, a closed lower end, a wall, and a longitudinal axis;

exactly six jet spray nozzles penetrating said wall of said cylinder, for spraying slurry from said hollow cylinder in a radially outward direction, said direction being oriented substantially perpendicular to said longitudinal axis; wherein said six jet spray nozzles further comprise:

a pair of primary nozzles, having an inside nozzle diameter equal to $D_p$;

four secondary nozzles, having an inside nozzle diameter equal to $D_s$;

wherein $D_p$ is larger than $D_s$; and wherein said pair of primary nozzles further comprise:

a first primary nozzle that penetrates said wall at a circumferential angle equal to zero degrees; and a second primary nozzle that penetrates said wall at a circumferential angle approximately equal to 180 degrees; and wherein said four secondary nozzles further comprise:

a first secondary nozzle that penetrates said wall at a circumferential angle $\theta$ approximately equal to $\theta_{offset}$;

a second secondary nozzle that penetrates said wall at a circumferential angle $\theta$ approximately equal to $-\theta_{offset}$;

a third secondary nozzle that penetrates said wall at a circumferential angle $\theta$ approximately equal to $180+\theta_{offset}$; and a fourth secondary nozzle that penetrates said wall at a circumferential angle $\theta$ approximately equal to $180-\theta_{offset}$; and wherein said circumferential offset angle, $\theta_{offset}$, has a value between about 20 and 40 degrees.

2. The jet grout injector subassembly of claim 1, wherein said primary and secondary nozzles are replaceable.

3. The jet grout injector subassembly of claim 1, wherein said closed lower end has a pointed, conical shape.

4. The jet grout injector subassembly of claim 1, further comprising a drill bit assembly attached to said closed lower end.

5. The jet grout injector subassembly of claim 1, wherein said primary and secondary nozzles are located in close axial proximity to each other on said hollow cylinder.

6. The jet grout injector subassembly of claim 1, wherein said primary and secondary nozzles are located at substantially the same axial location on said hollow cylinder.

7. The jet grout injector subassembly of claim 1, wherein said circumferential offset angle, $\theta_{offset}$, is about 30 degrees.

8. A method of constructing a underground barrier wall comprising the steps of:

inserting the jet grout injector subassembly of claim 1 down a first hole in the ground;

rotating said jet grout injector subassembly about its longitudinal axis until a proper angular alignment of said subassembly relative to the surrounding ground is achieved;

supplying slurry under pressure to said jet grout injector subassembly; and spraying said slurry radially outwards through a pair of primary nozzles in substantially diametrically opposed directions to a greater radial depth of penetration, and simultaneously spraying said slurry through a plurality of secondary nozzles in directions other than said diametrically opposed directions to a lessor radial depth of penetration, while simultaneously withdrawing, without rotation, said jet grout injector subassembly from said first hole;

whereby a first barrier wall panel is formed having a substantially uniform wall thickness and having two edges defined by said greater radial depth of penetration of slurry sprayed from said primary nozzles.

9. The method of claim 8, further comprising the steps of:

selecting a hole spacing distance equal to $S_{hole}$;

providing a second hole drilled into the ground, wherein said second hole is located at a distance $S_{hole}$ from said first hole;

moving said jet grout injector subassembly from said first hole to said second hole;

inserting said jet grout injector subassembly down said second hole;

rotating said jet grout injector subassembly about its longitudinal axis until a proper angular alignment of said subassembly relative to said proper angular alignment of said subassembly in said first hole is achieved;

supplying slurry under pressure to said jet grout injector subassembly; and spraying said slurry radially outwards through a pair of primary nozzles in substantially diametrically opposed directions to a greater radial depth of penetration, and simultaneously spraying said slurry through a plurality of secondary nozzles in directions other than said diametrically opposed directions to a lessor radial depth of penetration, while simultaneously withdrawing, without rotation, said jet grout injector subassembly from said first hole;

whereby a second barrier wall panel is formed having a substantially uniform wall thickness and having two edges defined by said greater radial depth of penetration of slurry sprayed from said primary nozzles; and repeating all of these steps as many times as necessary to create an interconnected underground barrier wall structure having multiple panels;

wherein said step of selecting said hole spacing distance further comprises selecting said hole spacing distance so that one edge of said first barrier wall panel approximately touches an edge of said second barrier wall panel.

10. The method of claim 8, further comprising the step of using a drill bit assembly attached to a jet grout injector subassembly, wherein said drill bit assembly drills a hole in the ground while simultaneously carrying said attached jet grout injector assembly down said hole.

11. The method of claim 9, further comprising the step of using a drill bit assembly attached to a jet grout injector subassembly, wherein said drill bit assembly drills each hole in the ground while simultaneously carrying said attached jet grout injector assembly down said hole.

12. The method of claim 8, wherein said circumferential offset angle, $\theta_{offset}$, is about 30 degrees.

13. The method of claim 8, wherein said slurry comprises a substantially impermeable material.

14. The method of claim 13, wherein said substantially impermeable material comprises a cement-based grout mixture.

15. The method of claim 8, wherein said slurry comprises at least one permeable reactive material.

16. The method of claim 15, wherein said permeable reactive material is a material selected from the group consisting of:

active agents used in chemical precipitation treatment methods, active agents used in oxidation-reduction reaction treatment methods, active agents used in zero-valent metal dehalogenation treatment methods, active agents used in biological degradation treatment methods, active agents used in sorption of organics treatment methods, and active agents used in sorption of inorganics treatment methods.

17. The method of claim 9, wherein the orientation of each adjacent panel is aligned substantially parallel to, and substantially in-line with, each other.

18. The method of claim 9, wherein the orientation of each adjacent panel is alternatively angled back and forth to create a folded, accordion-like pattern, wherein each panel intersects each adjoining panel.

19. The method of claim 8, wherein the orientation at least one portion of said first hole is angled less than 90 degrees with respect to the ground's surface by using directional drilling techniques.

20. The method of claim 8, wherein the orientation of said first hole is substantially perpendicular to the ground's surface.

21. The method of claim 9, wherein the orientation at least one portion of said second hole is angled less than 90 degrees with respect to the ground's surface by using directional drilling techniques.

22. The method of claim 9, wherein the orientation of said second hole is substantially perpendicular to the ground's surface.

23. A method of constructing an underground wall structure having a substantially uniform wall thickness, comprising:

inserting a jet grout injector subassembly into a hole in the ground;

supplying slurry under pressure to said subassembly;

spraying said slurry radially outwards into a cone-shaped primary zone;

filling-in the thin regions adjacent to the primary zone by simultaneously spraying said slurry radially outwards into a plurality of smaller, cone-shaped secondary zones located on both sides of the primary zone; and withdrawing the subassembly from the hole during grout spraying.

* * * * *